US006568676B2

(12) United States Patent
Manna et al.

(10) Patent No.: US 6,568,676 B2
(45) Date of Patent: May 27, 2003

(54) REMOVABLE TURNBAR IN A SHEET ACCUMULATOR

(75) Inventors: Robert E. Manna, Newtown, CT (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 19 days.

(21) Appl. No.: 09/981,041

(22) Filed: Oct. 17, 2001

(65) Prior Publication Data

US 2003/0080502 A1 May 1, 2003

(51) Int. Cl.[7] ..... B65H 29/60
(52) U.S. Cl. ..... 271/303; 270/58.01; 270/59
(58) Field of Search ..... 271/303, 288, 271/289, 290; 270/58.01, 59

(56) References Cited

U.S. PATENT DOCUMENTS

| | | | | |
|---|---|---|---|---|
| 4,190,241 A | | 2/1980 | Krueger | 270/47 |
| 4,354,671 A | | 10/1982 | Bergland | 270/58 |
| 4,355,795 A | | 10/1982 | Bergland | 270/58 |
| 4,585,113 A | | 4/1986 | Greenwell | 198/347 |
| 4,676,495 A | | 6/1987 | Hughes | 270/58 |
| 4,905,044 A | | 2/1990 | Hamano | 355/206 |
| 4,989,853 A | | 2/1991 | Matysek et al. | 270/58 |
| 5,258,817 A | | 11/1993 | Acquaviva | 355/320 |
| 5,445,368 A | * | 8/1995 | Lester et al. | 270/59 |
| 6,161,828 A | * | 12/2000 | Sussmeier | 270/59 |
| 6,199,850 B1 | * | 3/2001 | Seki | 270/58.07 |
| 6,273,419 B1 | * | 8/2001 | Allen et al. | 271/303 |
| 6,439,562 B1 | * | 8/2002 | Cote et al. | 270/52.17 |

FOREIGN PATENT DOCUMENTS

| | | | |
|---|---|---|---|
| JP | 5-286619 | * 11/1993 | 271/303 |

* cited by examiner

*Primary Examiner*—Patrick H. Mackey
(74) *Attorney, Agent, or Firm*—Michael J. Cummings; Charles R. Malandra, Jr.; Angela N. Chaclas

(57) ABSTRACT

A turnbar for use in a sheet accumulator having an accumulating assembly which causes sheets serially and separately entering an entry point to overlap each other to form a stack at an exit point. The turnbar is used to change the direction of the sheets at the entry point and the stack at the exit point. The turnbar can be disengaged from the accumulating assembly for jam clearance and maintenance purposes. Preferably, the turnbar has a securing mechanism for removably mounting the turnbar on the sheet accumulator.

14 Claims, 8 Drawing Sheets

| | | |
|---|---|---|
| FIG.4A | FIG.4B | FIG.4C |

REMOVABLE TURNBAR IN A SHEET ACCUMULATOR

TECHNICAL FIELD

The present invention relates generally to an inserting machine for mass mailing and, more specifically, a device to cause a large number of separate cut sheets to be accumulated into individual stacks each having a number of sheets.

BACKGROUND OF THE INVENTION

Multi-station document inserting systems are generally used by organizations such as banks, insurance companies and utility companies for producing a large volume of specific mailings where the contents of each mailpiece are directed to a particular addressee. One of the most important features of the inserting systems is speed, which is measured by the number of mailpieces that can be assembled in a given time period. A modern inserting system is expected to assemble over ten thousand mailpieces per hour. A typical inserting system includes a plurality of serially arranged stations including a sheet feeding station, a folding station and an insertion station. In general, the sheet feeder feeds one or a plurality of sheets of mailing materials to an accumulator, which collects the fed sheets into a predefined collated packet or stack. Mailing materials are usually printed on a continuous web of paper and the printed paper is cut into individual sheets. These sheets are then accumulated into individual stacks and each stack is stuffed into an envelope for mailing. One of the conventional ways of sheet accumulation is to slow down or stop the sheets in an impending accumulation (i.e., for a mailpiece) at a certain point until all the sheets have arrived. This conventional method is cumbersome and inefficient because it requires a drastic change in machine speed.

As disclosed in related patent application Ser. No 09/310,217, now issued as U.S. Pat. No. 6,273,419 sheets $\mathbf{100}_1$, $\mathbf{100}_2$, $\mathbf{100}_3$ are accumulated in an apparatus 1, which has a plurality of paths 211, 212, 213, . . . , connecting the entry point 2 and the exit point 4, with each path having a different pathlength. Related U.S. Pat. No. 6,273,419 in hereby expressly incorporated by reference. The paths are so controlled that, for each stack of the sheets in an impending accumulation, a sheet entering the accumulator will travel a progressively shorter path than the preceding one. In other words, the first sheet travels a longer path than the second sheet, the second sheet travels a longer path than the third sheet, and so forth. The pathlength difference between two successive paths can be designed in accordance with the requirement in sheet stacking. If the sheets are stacked in a way that one sheet is partially overlapped with another, like the shingle pattern on a rooftop (see stack 110, FIG. 1), then the pathlength difference between two successive paths is smaller than the length of the sheets. If the edges of the accumulated sheets in a stack are flush with each other, then the pathlength difference is substantially equal to the sheet length. For example, if only three sheets 1001, 1002, 1003 are to be accumulated into a stack 110, then sheets $\mathbf{100}_1$ $\mathbf{100}_2$, $\mathbf{100}_3$ are separately directed to paths 213, 212 and 211, respectively, as shown in FIG. 2. As shown in FIG. 2, when the sheets to be accumulated enter the entry point 2 along a path 200, they are caused to change direction so that they can be separately directed toward different paths. As shown, the direction of incoming sheets is changed from 200 to 202. After being accumulated, the stacked sheets are moved along path 218 and they are again caused to change direction to path 220 before exiting through the exit point 4.

As sheets are moved in high speed in and out of the accumulating apparatus 1, jams could occasionally occur. It is advantageous and desirable to provide a way to clear the jam.

SUMMARY OF THE INVENTION

It is an object of the present invention to provide an apparatus for sheet accumulation, wherein the sheets to be accumulated are not required to slow down significantly or pause in the accumulation process.

It is another object of the present invention to provide an apparatus for sheet accumulation, wherein the apparatus can have a small footprint.

It is yet another object of the present invention to provide an apparatus for sheet accumulation, which has a turnbar to change the direction of the sheets to be accumulated when the sheets are separately entering the accumulation apparatus, and the direction of the accumulated stack when the stack exits the accumulation apparatus. As such, the sheets prior to accumulation and the accumulated stack travel in the same direction. According to the present invention, the turnbar can be removed from the accumulation apparatus for jam clearance and maintenance purposes.

Accordingly, the first aspect of the present invention is a sheet accumulator, which comprises:

an accumulating assembly that accumulates a plurality of sheets that serially and separately enter an entry point so as to allow these sheets to overlap each other thereby forming a stack at an exit point, the accumulator having a plurality of paths connecting the entry point and the exit point with each path having a different path length, and means for controlling the paths so as to allow each sheet of said plurality of sheets to travel a different path such that a sheet entering the entry point travels a shorter path than a preceding sheet, wherein the sheets travel along a first direction prior to entering the entry point, a second direction different from the first direction after entering the entry point, a third direction different from the second direction prior to leaving the exit point, and a fourth direction different from the third direction after leaving the exit point;

a removable turnbar having first means located in the proximity of the entry point for directing the sheets entering the entry points from the first direction to the second direction, and second means located in the proximity of the exit point for directing the sheets leaving the exit point from the third direction to the fourth direction.

Preferably, the turnbar is operable at a first position and a second position, and wherein when the turnbar is operated at the first position, the turnbar is engaged with the accumulating assembly for directing the sheets entering the entry point from the first direction to the second direction and for directing the sheets leaving the exit point from the third direction to the fourth direction, and when the turnbar is operated at the second position, the turnbar is disengaged from the accumulating assembly to facilitate maintenance and/or jam clearance of the sheet accumulator.

Preferably, the sheet accumulator further comprises a securing mechanism to prevent the turnbar from being disengaged from the accumulating assembly when the turnbar is operated at the first position, wherein the security mechanism comprises a pin on the turnbar which is engaged with a latch on the accumulating assembly.

Preferably, the sheet accumulator further comprises a securing mechanism to prevent the turnbar from accidentally engaging with the accumulating assembly when the turnbar is operated in the second position, wherein the security mechanism comprises a pin on the turnbar which is engaged with a latch on the accumulating assembly.

The second aspect of the present invention is a turnbar for use in a sheet accumulator having an accumulating assembly, wherein the accumulating assembly accumulates a plurality of sheets that serially and separately enter an entry point so as to allow these sheets to overlap each other and thereby form a stack at an exit point, the accumulator having a plurality of paths connecting the entry point and the exit point with each path having a different path length, and means for controlling the paths so as to allow each sheet of said plurality of sheets to travel a different path such that a sheet entering the entry point travels a shorter path than a preceding sheet, wherein the sheets travel along:

a first direction prior to entering the entry point;

a second direction different from the first direction after entering the entry point;

a third direction different from the second direction prior to leaving the exit point; and a fourth direction different from the third direction after leaving the exit point. The turnbar comprises:

a first means located in the proximity of the entry point for directing the sheets entering the entry point from the first direction to the second direction;

a second means located in the proximity of the exit point for directing the sheets leaving the exit point from the third direction to the fourth direction; and a mounting mechanism for removably mounting the turnbar on the sheet accumulator.

According to the present invention, the sheets are capable of leaving the exit point along the fourth direction in a first exit path or a second exit path, and the turnbar further comprises a path diverting mechanism for selecting either the first or the second path.

According to the present invention, the turnbar further comprises a center bar located between a first side arm and a second side arm, wherein the first side arm has a first surface substantially parallel to the first direction for guiding the sheets to move toward the entry point, the second side arm has a second surface substantially parallel to the fourth direction for guiding the sheets to move away from the exit point, the center bar has a third surface substantially parallel to the second direction for guiding the sheets to move toward the accumulating assembly in the second direction and a fourth surface substantially parallel to the third direction for guiding the sheets to move toward the exit point in the third direction.

According to the present invention, the first means may comprise a curved surface located between the first surface and the third surface for urging the sheets to move from the first direction to the second direction, and the second means may comprise a curved surface located between the second surface and the fourth surface for urging the sheets to move from the third direction to the fourth direction.

According to the present invention, the sheets are capable of leaving the exit point along the fourth direction in a first exit path along the second surface or a second path spaced from the second surface, and wherein the turnbar further comprises a path diverting mechanism for selecting either the first or the second path.

According to the present invention, the path diverting mechanism comprises a flipper operable at a first position to allow the sheets to reach the second curved surface and a second position protruding into the third direction to cause the sheets to move toward the second path.

The present invention will become apparent upon reading the description taken in conjunction with FIGS. 3 to 6*b*.

DETAILED DESCRIPTION OF THE INVENTION

Figure 1:
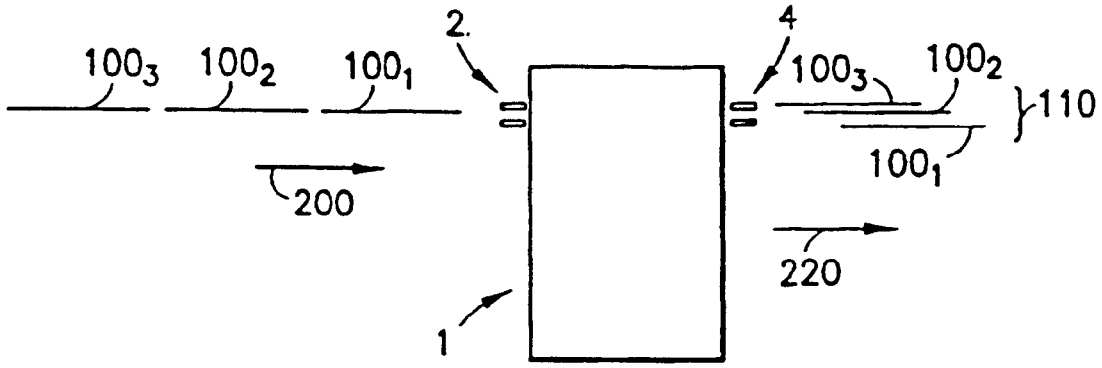
FIG. 1 is a diagrammatic representation illustrating the function of a sheet accumulator.
Figure 2:
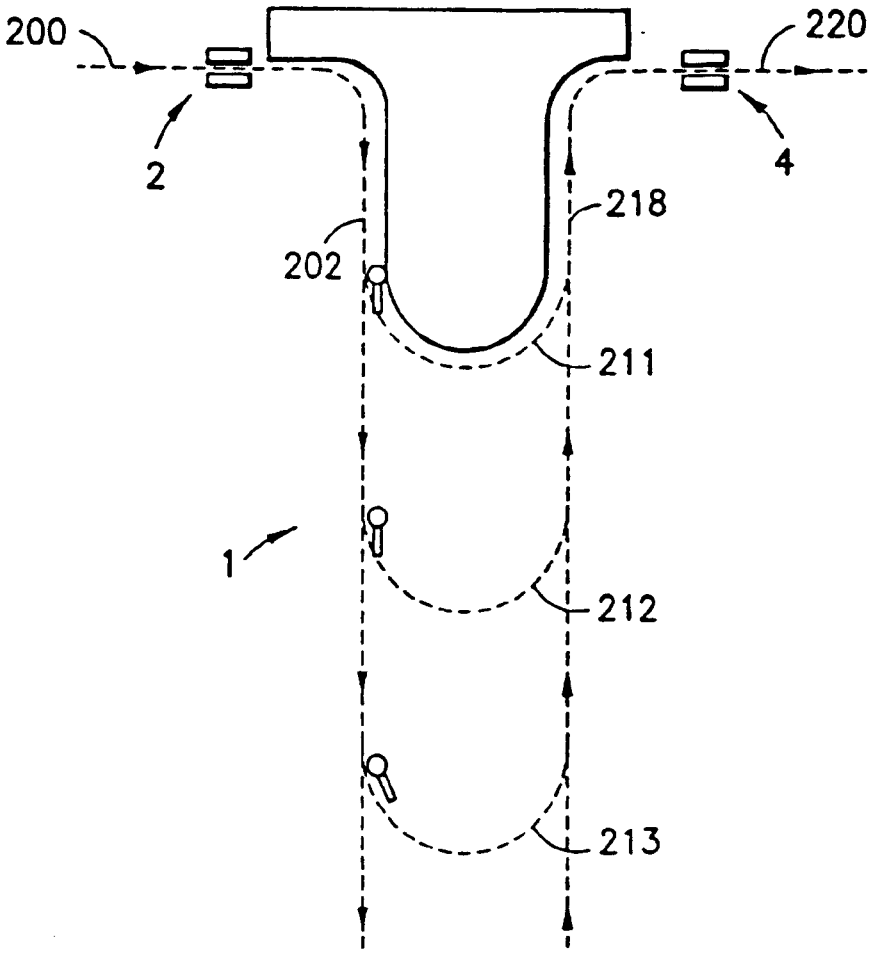
FIG. 2 is a diagrammatic representation illustrating the principle of the sheet accumulator.
Figure 3:
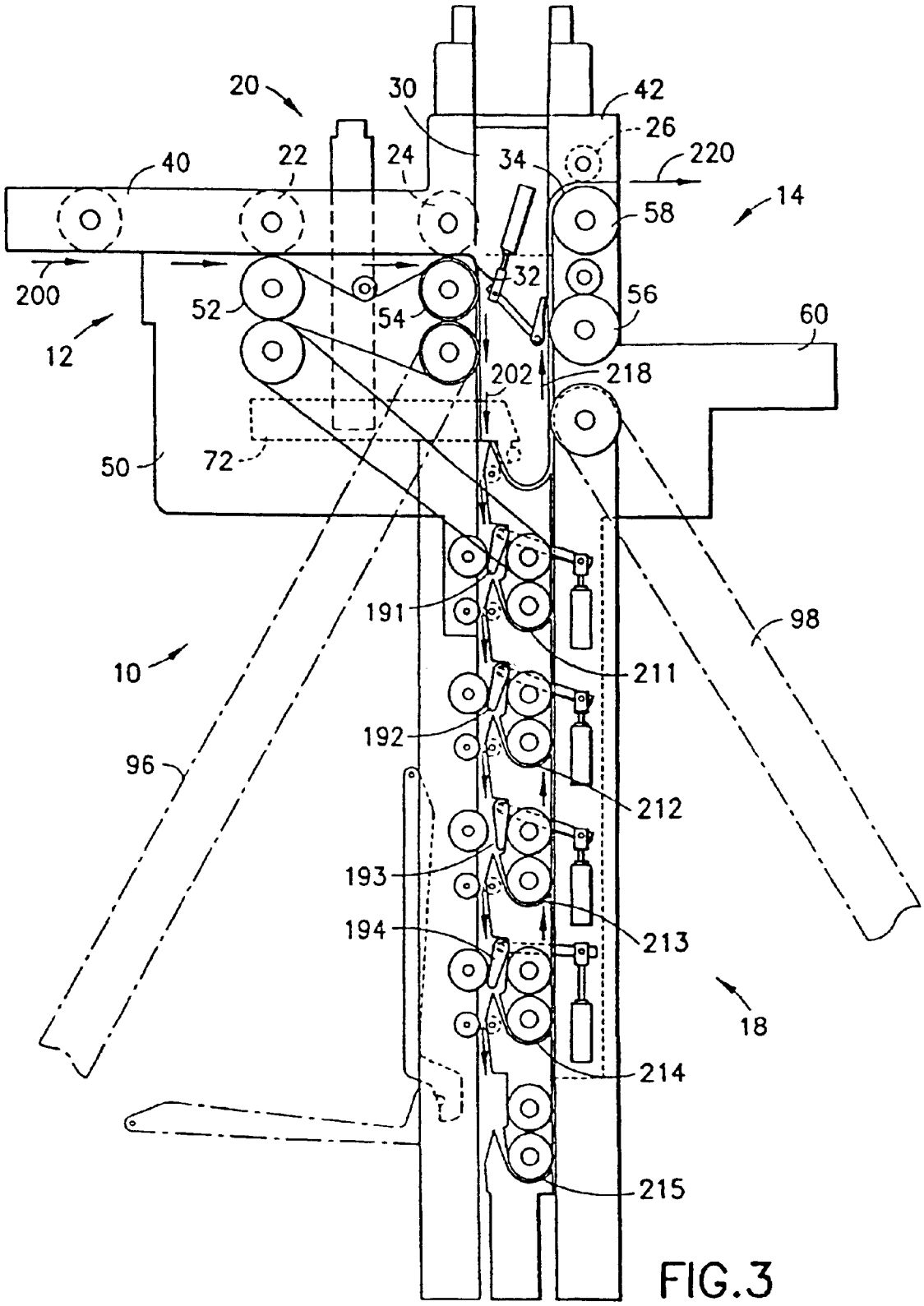
FIG. 3 is a cross sectional view illustrating the sheet accumulator having an accumulating assembly and a turnbar, according to the present invention, wherein the turnbar is operated in a "home" position.

Referring to FIG. 3, the sheet accumulator 10, according to the present invention, comprises an accumulating assembly 18 and a turnbar 20 located on top of the accumulating assembly 18. The turnbar 20 has a first side arm 40, a second side arm 42, and a center bar 30 located between the first and second side arms. The accumulating assembly 18 has a first top section 50 and a second top section 60 defining a gap 62 (see FIG. 4B) to engage with the center bar 30 when the turnbar 20 is mounted on the accumulating assembly for normal operation. The first side arm 40 of the turnbar 20 has one or more rollers 22, 24 to form an entry point 12 of the sheet accumulator with one or more rollers 52, 54 on the first top section 50 of the accumulating assembly 18. The first side arm 40 and the first top section 50 further have rollers 24 and 54 to move a sheet (not shown) from the entry point 12 into the accumulating assembly 18. As shown in FIG. 3, a curved section 32 on the left side of the center bar 30 causes the sheet to change direction, as indicated by the rightward path 200 to the downward path 202. The curved section 32 is located between a surface 31 of the first side arm 40 and a surface 33 of the center bar 30 (see FIG. 4*a*). If four sheets (not shown) are accumulated into one stack (not shown), then the first sheet is caused to travel along the path 214; the second sheet is caused to travel along the path 213; the third sheet is caused to travel along the path 212, and the fourth sheet is caused to travel along path 211. The traveling paths are controlled by a plurality of flippers 191, 192, 193 and 194. The control of the traveling paths is not part of the present invention. After the sheets have traveled past their designated paths, they travel along the upward path 218 in an overlapping manner. The stack is then caused by a curved surface 34 on the upper right side of the center bar 30 to change direction, from the upward path 218 to the rightward path 220 at an exit point 14. The curved surface 34 is located between a surface 37 of the second side arm 42 and a surface 35 of the center bar 30 (see FIG. 4*a*). Thus, the main function of the turnbar 20 is to direct the sheets entering the entry point from the rightward path 200 to the downward path 202, and direct the stack from the upward path 218 to the rightward path 220 at the exit point 14.

The sheet accumulator 10 has two side doors 96 and 98 for covering both sides of the accumulating assembly 18. The side doors 96 and 98 can be swung out to a clear paper jam around any one of the paths 211–215, as shown in FIG. 3. However, if the jam occurs in the path near the first top section 50 or second top section 60, it may be quite difficult to clear the jammed sheets. Thus, it is preferable that the turnbar 20 can be separated from the accumulating assembly 18 for jam clearance and for maintenance purposes.

Figures 4, 4A:
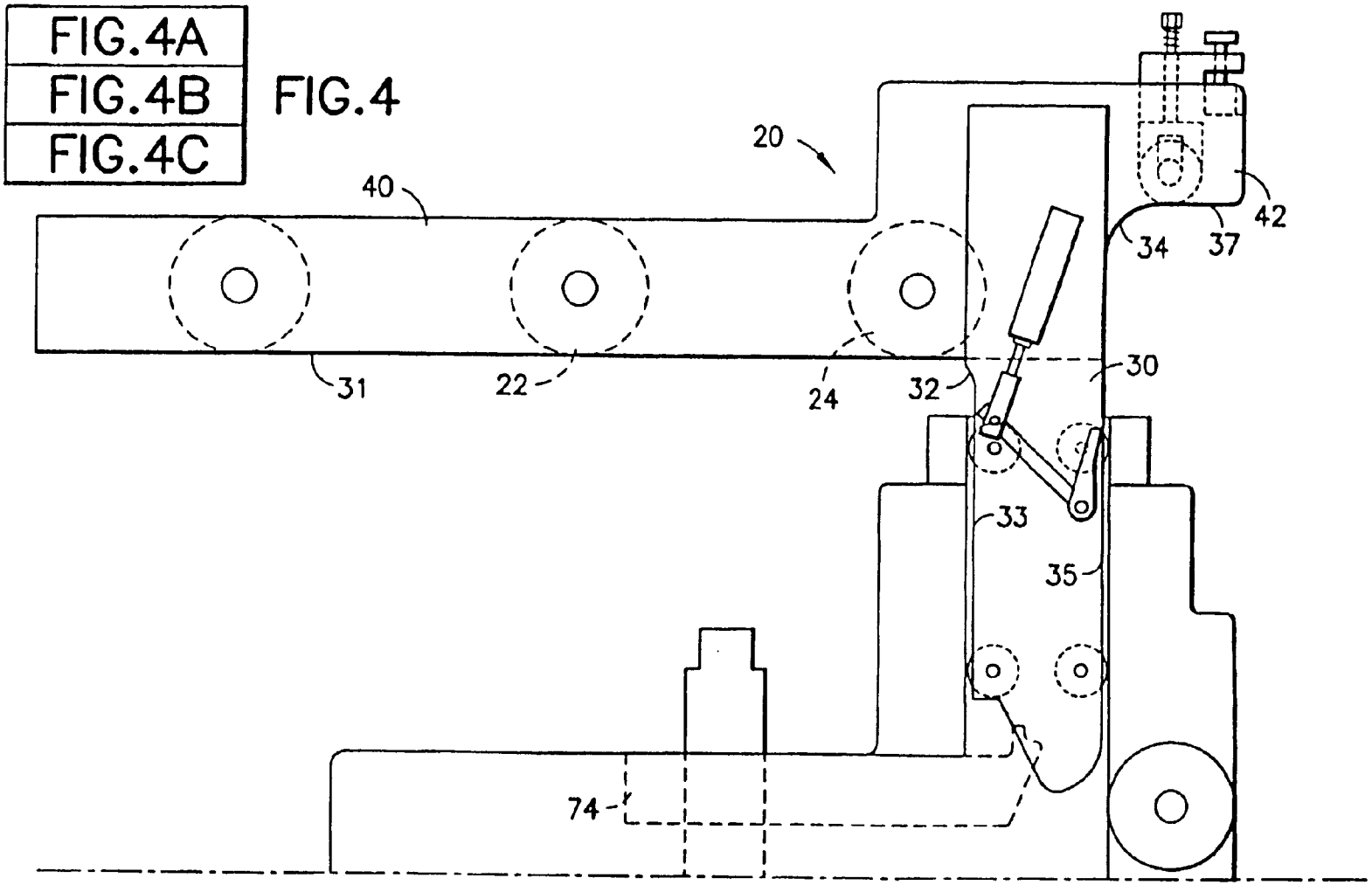
FIG. 4*a* is a cross sectional view of the upper portion of the sheet accumulator illustrating the turnbar being disengaged from the accumulating assembly.
Figure 4B:
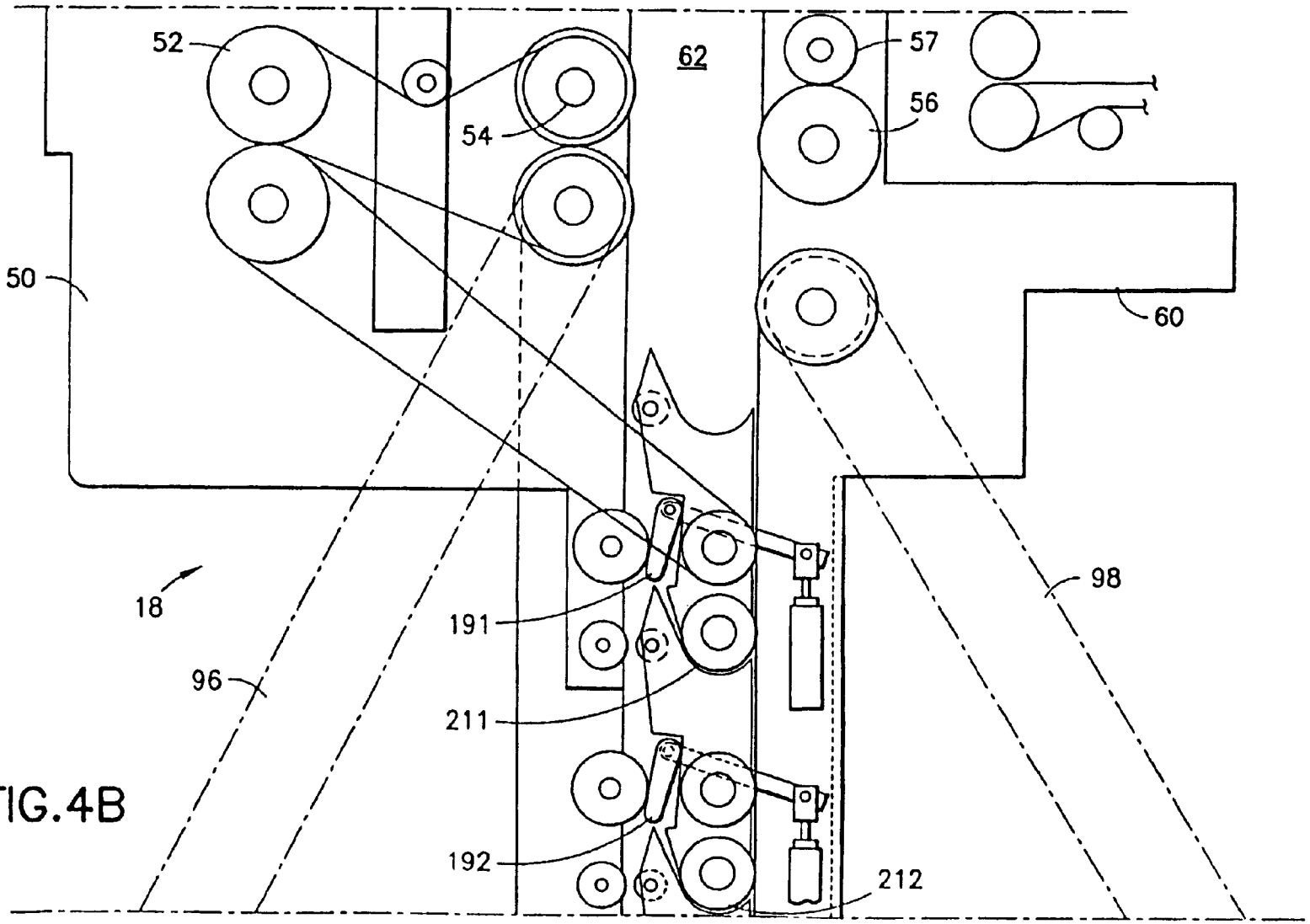
FIG. 4*b* is a cross sectional view of the middle portion of the sheet accumulator illustrating the turnbar being disengaged from the accumulating assembly.
Figure 4C:
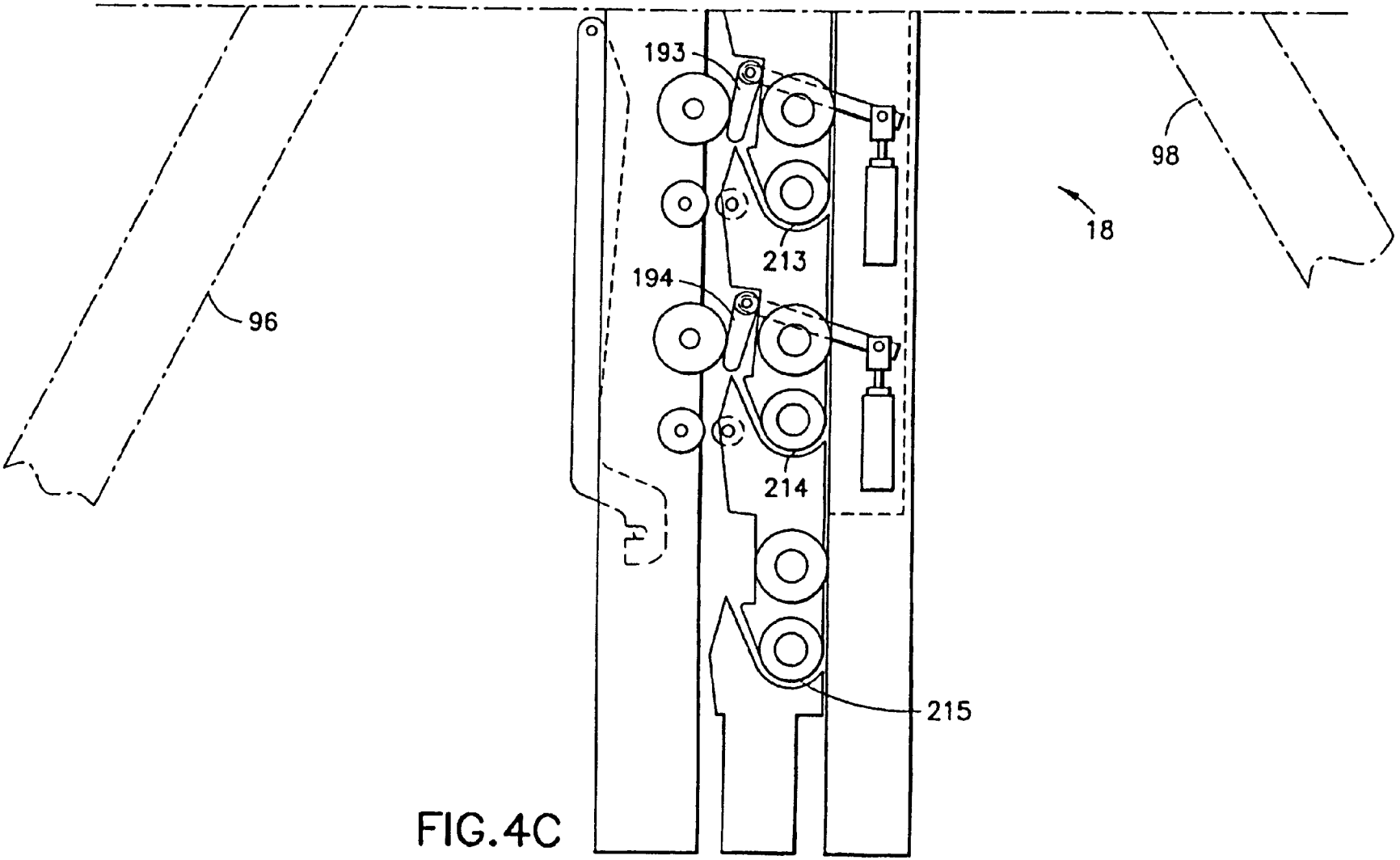
FIG. 4*c* is a cross sectional view illustrating the lower portion of the sheet accumulator.

As shown in FIGS. 4*a* to 4*c*, the turnbar 20 can be pulled upward, away from the accumulating assembly 18, thereby exposing the gap 62, the first top section 50 and the second top section 60. As such, the rollers 22 and 24 are separated from the rollers 52 and 54, making it easy to remove any sheets that are stuck near the entry point 12 or the exit point 14. Preferably, the turnbar 20 has a securing mechanism to allow the turnbar 20 to engage with a lower latch 72 when the turnbar 20 is fully engaged with the accumulating assembly 18 in a "home" position. The same mechanism is also engaged with an upper latch 74 when the turnbar 20 is disengaged from the accumulating assembly 18. The upper latch 74 and the lower latch 72 are shown in more detail in FIGS. 5*a* and 5*b*.

Figure 5A:
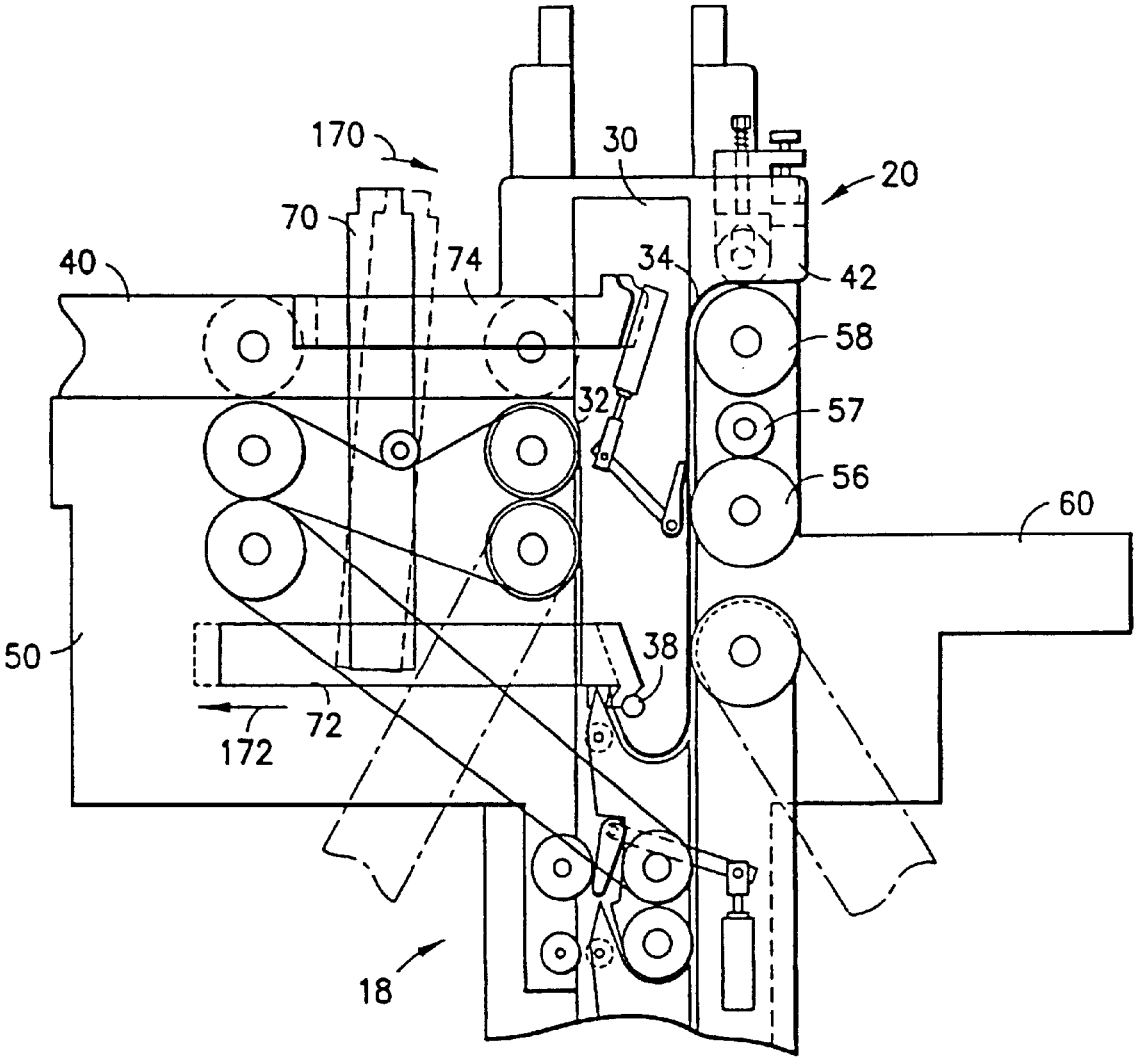
FIG. 5*a* is a cross sectional view illustrating a mechanism for securing the turnbar on the sheet accumulator when the turnbar is engaged with the accumulating assembly.

FIG. 5*a* shows the turnbar 20 being in the home position and the lower latch 72 in a locking position. As shown, the pin 38 is engaged with the lower latch 72, preventing the turnbar 20 from being pulled upward. However, when the lower latch 72 is shifted to the left, as indicated by arrow 172, to disengage the pin 38 therewith by turning the lever 70 in a clockwise direction 170, the turnbar 20 can be pulled upward to separate it from the accumulating assembly 18.

Figure 5B:
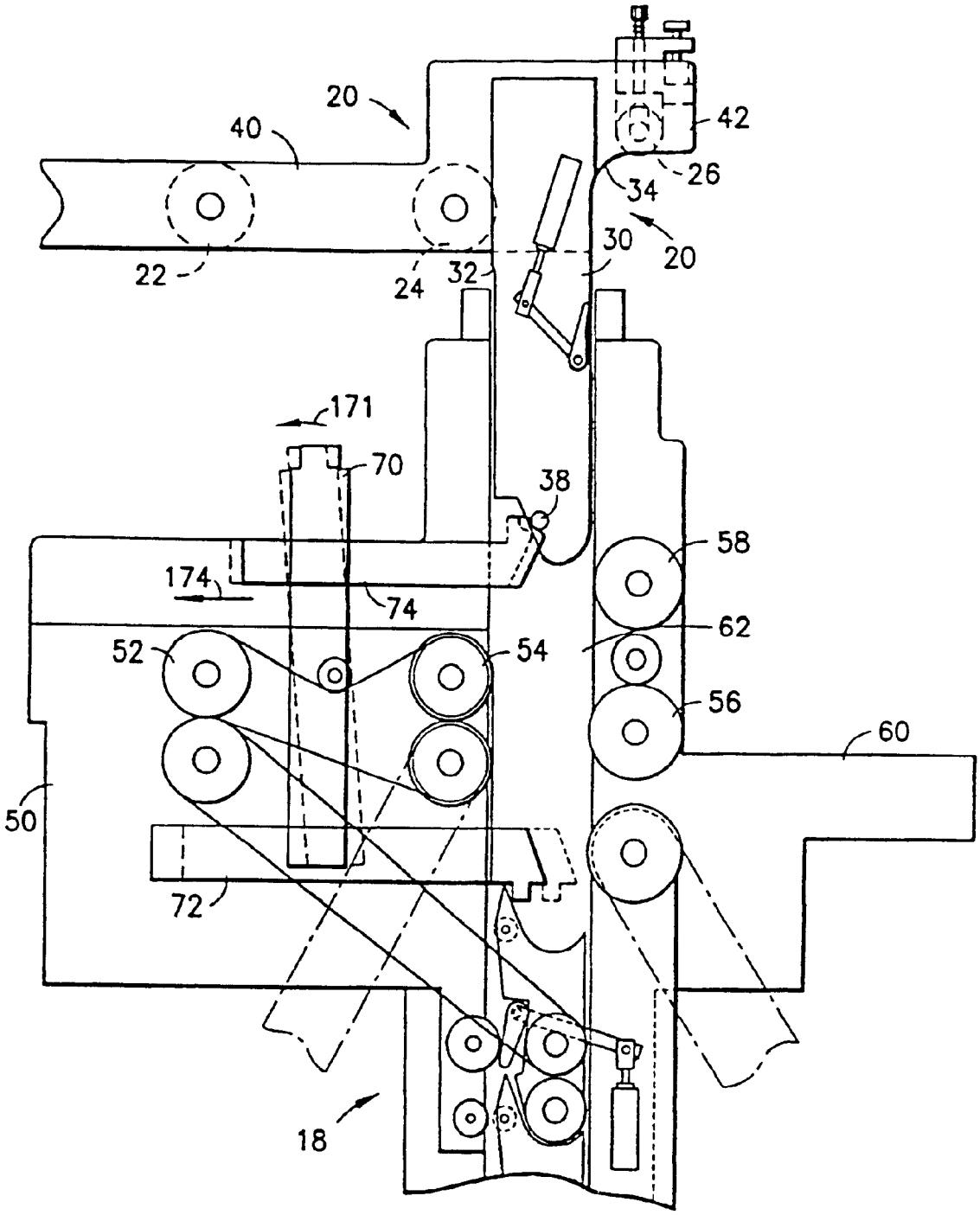
FIG. 5*b* is a cross sectional view illustrating a mechanism for securing the turnbar on the sheet accumulator when the turn is disengaged with the accumulating assembly.

FIG. 5*b* shows the turnbar 20 being in the disengaged position and the upper latch 74 in a locking position. As shown, the pin 38 is engaged with the upper latch 74, preventing the turnbar 20 from being moved downward. However, when the upper latch 74 is shifted to the left, as indicated by arrow 174, to disengage the pin 38 therewith by turning the lever 70 in a counter-clockwise direction 171, the turnbar 20 can be pushed downward to its home position.

Figure 6B:
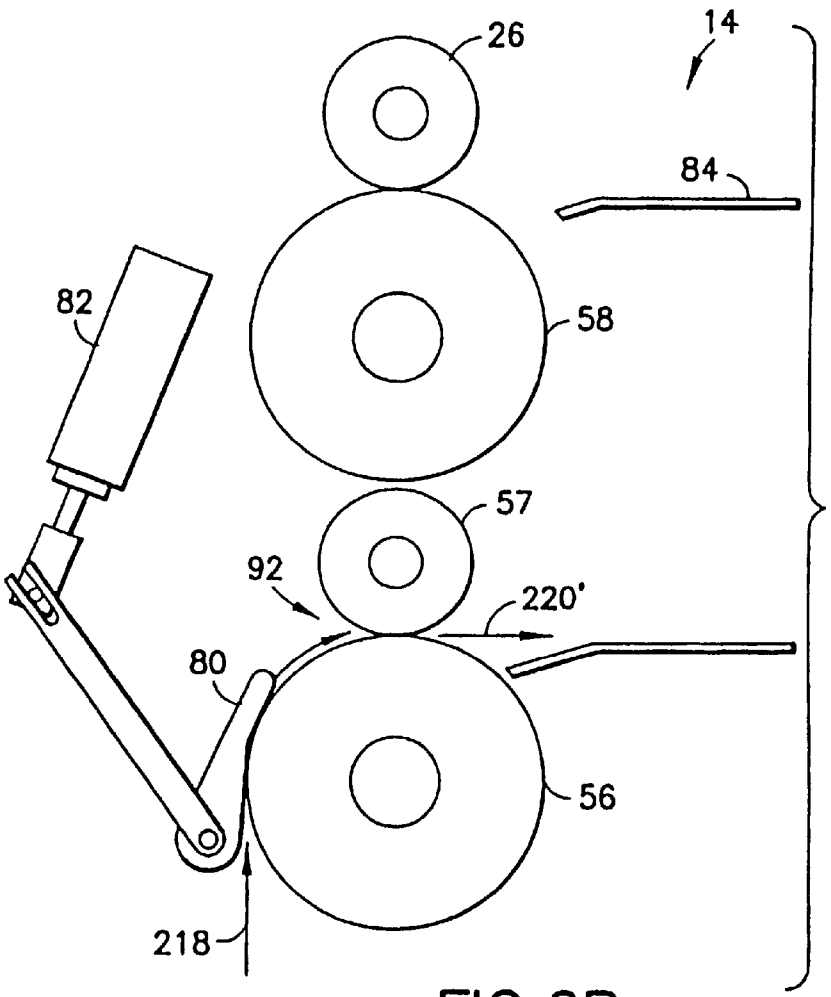
FIG. 6*b* is a diagrammatic representation illustrating a path diverting mechanism to cause a stack of accumulated sheets to move along a second exit path.
Figure 6A:
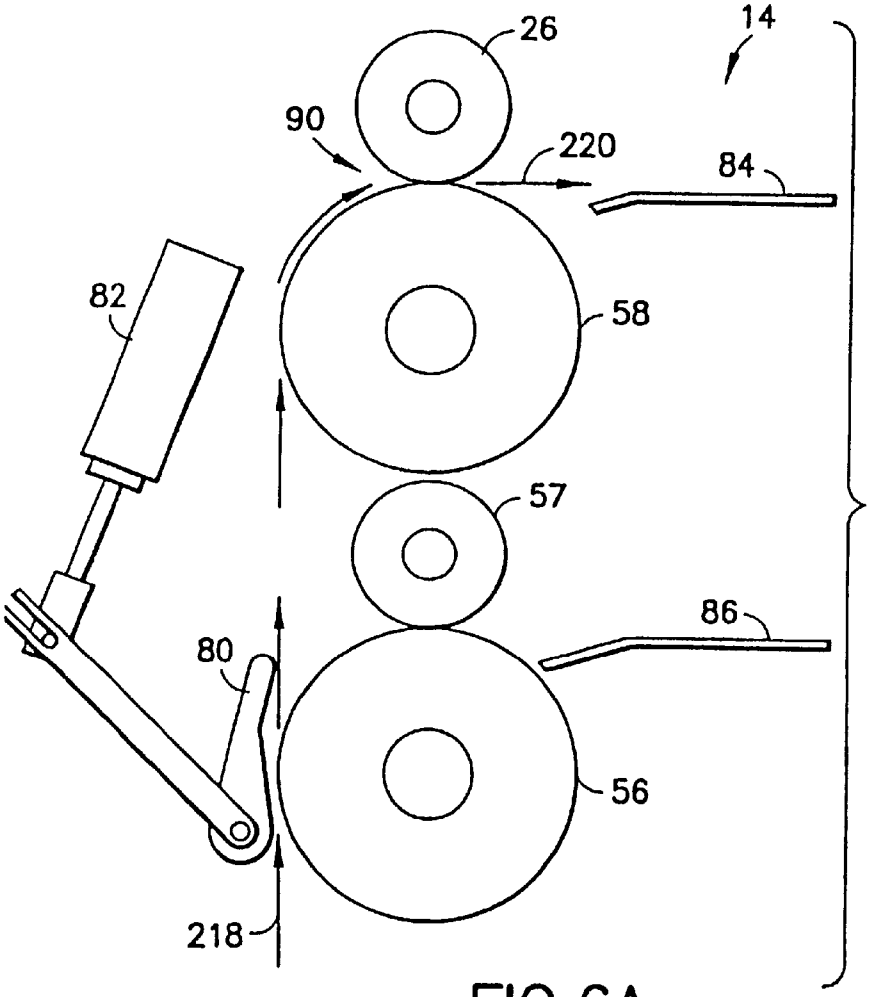
FIG. 6*a* is a diagrammatic representation illustrating a first exit path of the sheet accumulator.

FIGS. 6*a* and 6*b* show that at the exit point 14 of the sheet accumulator 10, a stack of accumulated sheets (not shown) moving along path 218, can exit along path 220 or path 220'. The paths are controlled by a flipper 80 operatively linked to an actuator 82. As shown in FIG. 6*a*, the actuator 82 keeps the flipper 80 away from the roller 56, allowing the stack to enter the nip 90 formed by a roller 26 and a roller 58. The stack is then moved by the rollers 26 and 58 along the path 220 onto a platform 84. In FIG. 6*b*, the actuator 82 pushes the flipper 80 to move close to a roller 56, causing the stack to enter a nip 92 formed by a roller 57 and the roller 56. The stack is then moved by the rollers 56 and 57 along path 220 onto a platform 84.

The removable turnbar 20, according to the present invention, has been disclosed as having means to cause the sheets entering the entry point to change direction, as indicated by arrows 200 and 202, and means to cause the stack exiting the exit point to change direction, as indicated by arrow 218, 220 and 226. However, it is not necessary that the turnbar changes the direction of the separated sheets and the accumulated sheets at both the entry point and the exit point. Furthermore, two exiting paths 220 and 220' at the exit point 14 can be alternately selected so that stacks moving along path 208 can be alternately directed to path 220 and 220'. However, when only one exiting path is needed, only one of the exiting paths will be selected. Thus, it is possible that the sheet accumulator has only one exiting path. Moreover, it is also possible to have more than two exiting paths.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A turnbar for use in a sheet accumulator having an accumulating assembly, wherein the accumulating assembly accumulates a plurality of sheets that serially and separately enter an entry point so as to allow these sheets to overlap each other and thereby form a stack at an exit point, said sheet accumulator having a plurality of paths connecting the entry point and the exit point with each path having a different path length, and means for controlling said paths so as to allow each sheet of said plurality of sheets to travel a different path such that a sheet entering the entry point travels a shorter path than a preceding sheet, wherein the sheets travel along a first direction prior to entering the entry point;

a second direction different from the first direction after entering the entry point;

a third direction different from the second direction prior to leaving the exit point; and a fourth direction different from the third direction after leaving the exit point, said turnbar comprising:

first means located in the proximity of the entry point for directing the sheets entering the entry point from the first direction to the second direction;

second means located in the proximity of the exit point for directing the sheets leaving the exit point from the third direction to the fourth direction; and a mounting mechanism for removably mounting the turnbar on said sheet accumulator.

2. The turnbar of claim 1, wherein the sheets are capable of leaving the exit point along the fourth direction in a first exit path or a second exit path, said turnbar further comprising a path diverting mechanism for selecting either the first or the second path.

3. The turnbar of claim 1, further comprising a center bar located between a first side arm and a second side arm, wherein the first side arm has a first surface substantially parallel to the first direction for guiding the sheets to move toward the entry point;

the second side arm has a second surface substantially parallel to the fourth direction for guiding the sheets to move away from the exit point;

the center bar has a third surface substantially parallel to the second direction for guiding the sheets to move toward the accumulating assembly in the second direction and a fourth surface substantially parallel to the third direction for guiding the sheets to move toward the exit point in the third direction.

4. The turnbar of claim 3, wherein the first means comprises a curved surface located between the first surface and the third surface for urging the sheets to move from the first direction to the second direction.

5. The turnbar of claim 3, wherein the second means comprises a curved surface located between the second surface and the fourth surface for urging the sheets to move from the third direction to the fourth direction.

6. The turnbar of claim 5, wherein the sheets are capable of leaving the exit point along the fourth direction in a first exit path along the second surface or a second path spaced from the second surface, and wherein the turnbar further comprises a path diverting mechanism for selecting either the first or the second path.

7. The turnbar of claim 6, wherein the path diverting mechanism comprises a flipper operable at a first position to allow the sheets to reach the second curved surface and a second position protruding into the third direction to cause the sheets to move toward the second path.

8. A sheet accumulator comprising:

an accumulating assembly that accumulates a plurality of sheets that serially and separately enter an entry point so as to allow these sheets to overlap each other thereby forming a stack at an exit point, said accumulating assembly having a plurality of paths connecting the entry point and the exit point with each path having a different path length, and means for controlling said paths so as to allow each sheet of said plurality of sheets to travel a different path such that a sheet entering the entry point travels a shorter path than a preceding sheet, wherein the sheets travel along a first direction prior to entering the entry point; a second direction different from the first direction after entering the entry point; a third direction different from the second direction prior to leaving the exit point; and a fourth direction different from the third direction after leaving the exit point, a removable turnbar having first means located in the proximity of the entry point for directing the sheets entering the entry point from the first direction to the second direction; and second means located in the proximity of the exit point for directing the sheets leaving the exit point from the third direction to the fourth direction.

9. The sheet accumulator of claim 8, further comprising a securing mechanism for removably mounting the turnbar on the sheet accumulator so as to allow said turnbar to be disengaged from the accumulating assembly to facilitate maintenance of the sheet accumulator.

10. The sheet accumulator of claim 8, wherein the turnbar is operable at a first position and a second position, and wherein when the turnbar is operated at the first position, the turnbar is engaged with the accumulating assembly for directing the sheets entering the entry point from the first direction to the second direction and for directing the sheets leaving the exit point from the third direction to the fourth direction, and when the turnbar is operated at the second position, the turnbar is disengaged from the accumulating assembly to facilitate maintenance and/or jam clearance of the sheet accumulator.

11. The sheet accumulator of claim 10, wherein the sheet accumulator further comprises a securing mechanism to prevent the turnbar from being disengaged from the accumulating assembly when the turnbar is operated at the first position.

12. The sheet accumulator of claim 10, wherein the sheet accumulator further comprises a securing mechanism to prevent the turnbar from accidentally engaging with the accumulating assembly when the turnbar is operated in the second position.

13. The sheet accumulator of claim 11, wherein the security mechanism comprises a pin on the turnbar which is engaged with a latch on the accumulating assembly.

14. The sheet accumulator of claim 12, wherein the security mechanism comprises a pin on the turnbar which is engaged with a latch on the accumulating assembly.

* * * * *